US009976344B2

(12) United States Patent
Nicolosi

(10) Patent No.: US 9,976,344 B2
(45) Date of Patent: May 22, 2018

(54) SYSTEM FOR CLOSING A VENETIAN BLIND OR THE LIKE HOUSED IN A DOUBLE GLAZING OR IN A DOUBLE GLASS, PROVIDED WITH MEANS FOR PREVENTING A MOVEMENT OF THE BLIND DURING THE TRANSPORT OR ASSEMBLY OF THE SYSTEM

(71) Applicant: PELLINI S.P.A., Codogno (LO) (IT)

(72) Inventor: Giovanni Nicolosi, Dresano (IT)

(73) Assignee: PELLINI S.P.A., Codogno (IT)

( * ) Notice: Subject to any disclaimer, the term of this patent is extended or adjusted under 35 U.S.C. 154(b) by 70 days.

(21) Appl. No.: 15/309,846

(22) PCT Filed: Mar. 24, 2015

(86) PCT No.: PCT/IT2015/000078
§ 371 (c)(1),
(2) Date: Nov. 9, 2016

(87) PCT Pub. No.: WO2015/177816
PCT Pub. Date: Nov. 26, 2015

(65) Prior Publication Data

US 2017/0175438 A1 Jun. 22, 2017

(30) Foreign Application Priority Data

May 22, 2014 (IT) ..... MI2014A0941

(51) Int. Cl.
*E06B 9/307* (2006.01)
*E06B 9/325* (2006.01)
(Continued)

(52) U.S. Cl.
CPC ..... *E06B 9/307* (2013.01); *E06B 9/264* (2013.01); *E06B 9/322* (2013.01); *E06B 9/325* (2013.01); *E06B 2009/2643* (2013.01)

(58) Field of Classification Search
CPC ..... E06B 9/307; E06B 9/322; E06B 9/325; E06B 9/26; E06B 9/264; E06B 9/30;
(Continued)

(56) References Cited

U.S. PATENT DOCUMENTS 6,561,252 B2 5/2003 Anderson et al.
7,681,618 B2 * 3/2010 Nicolosi ..... E06B 9/264 160/241

(Continued)

*Primary Examiner* — Beth A Stephan
(74) *Attorney, Agent, or Firm* — Pearne & Gordon LLP

(57) ABSTRACT

The invention refers to a system comprising a Venetian blind or the like housed within a double glazing or a double glass. The blind comprises a multiplicity of slats movable by means of a shaft rotatable around a longitudinal axis thereof and housed in a rolling-shutter box of the double glazing. The closure system comprises means for rotating the shaft around the longitudinal axis thereof. The rotation means are housed in a lateral profile of the double glazing and are commanded by a slider translatable between an upper end stop, at which the blind is completely raised, and a lower end stop, at which the blind is completely lowered. The closure system further comprises a first mechanism which prevents a movement of the blind until, during the transport or assembly of the closure system, the rolling-shutter box is disconnected from the lateral profile. The first blocking mechanism comprises three pins that can be rotated, together with the shaft, around the longitudinal axis thereof, and that can be translated between a first position at which the three pins are housed in three respective seats obtained in the cap of the rolling-shutter box, and a second position in which the three pins lie outside said seats. While the rolling-shutter box is disconnected from the lateral profile, the three pins are housed in the respective seats so as to prevent a rotation of the shaft for moving the slats. The closure system also comprises three counter-pins integrally connected to the lateral profile and arranged in a manner so (Continued)

as to push the three pins outside the respective seats upon connection of the rolling-shutter box to the lateral profile, so as to allow a rotation of the shaft for moving the slats. The closure system finally comprises a second mechanism for blocking the slider when the latter is situated at the upper end stop, i.e. when the blind is completely raised.

15 Claims, 9 Drawing Sheets

(51) Int. Cl.
*E06B 9/322* (2006.01)
*E06B 9/264* (2006.01)

(58) Field of Classification Search
CPC .... E06B 9/308; E06B 9/80; E06B 2009/3222; E06B 2009/285; E06B 2009/2643; E06B 2009/801
USPC ..... 160/305, 306, 107
See application file for complete search history.

(56) References Cited

U.S. PATENT DOCUMENTS

| | | | | |
|---|---|---|---|---|
| 2002/0003030 | A1 | 1/2002 | Anderson | |
| 2006/0108076 | A1 | 5/2006 | Huang | |
| 2007/0068635 | A1* | 3/2007 | Nicolosi | E06B 9/264 160/98 |
| 2014/0014281 | A1* | 1/2014 | Mullet | E06B 9/42 160/311 |
| 2014/0096920 | A1* | 4/2014 | MacDonald | E06B 9/50 160/291 |

* cited by examiner

SYSTEM FOR CLOSING A VENETIAN BLIND OR THE LIKE HOUSED IN A DOUBLE GLAZING OR IN A DOUBLE GLASS, PROVIDED WITH MEANS FOR PREVENTING A MOVEMENT OF THE BLIND DURING THE TRANSPORT OR ASSEMBLY OF THE SYSTEM

FIELD OF APPLICATION OF THE INVENTION

The present invention refers to the field of movable structures by means of which it is possible to mutually separate two environments or prevent, at least partially, the passage of light, air, sound waves or people through an opening in a wall that separates two separate environments. Among the movable structures belonging to this type, there are, by way of example, the blind or shutter closure systems.

Hereinbelow in the present description, with the expression "closure system" it is intended to identify all the movable structures of the aforesaid type.

The closure systems comprise:

- separation means (such as, for example, the blinds and the shutters) suitable for separating said environments or preventing said passage;
- a group for moving the separation means between at least one first position at which the separation means separate, at least partially, said environments or prevent, at least partially, said passage, and a second position at which the separation means do not separate said environments and do not prevent said passage.

More precisely, the present invention refers to a type of closure system whose movement group comprises:

- a member rotatable around an axis and connected to the separation means in a manner such that a rotation of the member rotatable around said axis causes a movement of the separation means;
- means for rotating the member rotatable around said axis.

The present invention in particular regards a closure system of the aforesaid type provided with means suitable for preventing a movement of the separation means during the assembly of the system.

REVIEW OF THE PRIOR ART AND DESCRIPTION OF THE TECHNICAL PROBLEM

In the closure systems referred to by the present invention, the movement of the separation means is commanded by a user of the closure system by means of suitable command means connected to the rotation means.

In summary, in the closure systems of the aforesaid type, the command means are connected to the rotation means, the rotation means are connected to the rotatable member and the rotatable member is connected to the separation means.

The rotation means and the command means are obtained in a manner such that the rotatable member, constrained in rotation to the rotation means, cannot rotate due only to the weight force acting on the separation means. In other words, with reference, by way of example, to a closure system comprising a Venetian blind whose slats are vertically translatable, the rotation means and the command means have a structure such to prevent a "lowering of the blind" (i.e. a translation of the slats towards the lower part of the closure system) due only to the weight force acting on the slats. This result is obtainable, for example, by obtaining the rotation means in a manner such to comprise a gear of "worm screw-helical cylindrical crown" type by means of which rotary motion can be transmitted from the rotation means to the rotatable member, but not in the reverse sense.

The connection between the rotatable member and the rotation means is a necessary condition in order to prevent the movement of the separation means due to the weight force acting thereon. Consequently, during the steps of transport and subsequent assembly of the closure system, until said connection is achieved between the rotation means and the rotatable member, the latter is free to rotate (and hence the separation means are free to move). This constitutes a problem each time the closure system has a structure such that, during the assembly thereof, the connection between the rotatable member and the separation means and the connection between the command means and the rotation means are carried out before the connection between the rotatable member and the rotation means. In these cases, indeed, when the rotatable member is connected to the rotation means, it is necessary that the separation means are in a specific configuration, as a function of the position assumed by the command means. With reference, by way of example, to the abovementioned Venetian blind closure system and assuming that the translation of the slats occurs by means of a system of tie rods windable on a shaft rotatable around an axis thereof, when the connection is achieved between said shaft and the rotation means thereof, the command means must usually be in a position corresponding to the configuration in which the blind is completely raised (i.e. with the slats lying in the position closest to the rotatable shaft).

While the rotation means are not connected to the rotatable member, the separation means could therefore be moved following the weight force acting thereon and/or due to the manipulations sustained by the components of the closure system during the assembly thereof. Consequently, the separation means might not be situated in said specific configuration when the rotatable member is connected to the rotation means (i.e. once again with reference to the abovementioned Venetian blind closure system, the blind may not be completely raised when the shaft for moving the slats is connected to the rotation means).

In order for the separation means to be maintained in said specific configuration up to the connection of the rotatable member to the rotation means, it is necessary to orient the separation means in a manner such that they do not tend to be moved due to the weight force acting thereon, and to limit as much as possible the movements of the components of the closure system during the transport and subsequent assembly thereof. In addition, each time said movements are required, they must be carried out as slowly and delicately as possible. However, these precautions slow the operations of transport and subsequent assembly, and have sometimes still proven insufficient for preventing a movement of the separation means and hence a moving away from said specific configuration.

In addition thereto, when an undesired movement of the separation means has been verified, it is necessary to rotate the rotatable member around its axis so as to bring the separation means back into said specific configuration before connecting the rotatable member to the rotation means. There is thus a further slowing of the transport and subsequent assembly operations of the closure system.

The latter problem is particularly felt in the field of movable blinds housed within structures comprising at least two mutually parallel glass panes sustained by a frame interposed thereto. These structures can consist, by way of example, of double glazings or pairs of opposite glass panes forming a wall. Such closure systems usually comprise:

a first structure for containing the rotatable member, generally placed at an upper portion of the closure system. Said first containment structure will be indicated hereinbelow in the present description with the expression "rolling-shutter box";

a second structure for containing the means for rotating the rotatable member, usually placed at a lateral portion of the closure system. Said second containment structure will be indicated hereinbelow in the present description with the expression "lateral profile".

The assembly of the closure systems comprising a blind housed in a double glazing is completed in glassworks, connecting the rolling-shutter box to the lateral profile before applying the glass panes. The connection between the rotatable member and the rotation means is achieved by connecting the rolling-shutter box to the lateral profile. This signifies that, during the assembly of the closure system, the rotatable member and the rotation means are respectively housed in the rolling-shutter box and in the lateral profile before being connected to each other. If the blind is at least partially lowered before the rolling-shutter box is connected to the lateral profile, the rotatable member being housed in the rolling-shutter box, it is therefore not easy to rotate the rotatable member around its axis so as to bring the blind back into the completely raised position.

OBJECTS OF THE INVENTION

The object of the present invention is to overcome the aforesaid drawbacks and to indicate a closure system obtained in a manner such that, during the assembly of the system, an undesired movement of the separation means is prevented.

SUMMARY OF THE INVENTION

The subject of the present invention is a system for opening and closing a communication path between two separate environments, the system comprising:

separation means suitable for mutually separating said environments or preventing, at least partially, the passage of light, air, sound waves or people through an opening in a wall interposed between said environments;

a group for moving the separation means between at least one first position at which the separation means separate, at least partially, said environments or prevent, at least partially, said passage, and a second position at which the separation means do not separate said environments and do not prevent said passage;

means for commanding the movement group;

the movement group comprising:

a member rotatable around an axis and connected to the separation means in a manner such that a rotation of said member around said axis causes a movement of the separation means. Hereinbelow in the present description, the rotatable member will be indicated with the expression "shaft";

means for rotating of the shaft around said axis, the command means comprising for commanding an actuation of the rotation means, the shaft and the rotation means being mutually connectable, the shaft being rotatable by the rotation means around said axis when the shaft and the rotation means are mutually connected;

a first structure for containing the shaft indicated hereinbelow in the present description with the expression "rolling-shutter box", the shaft being rotatable around said axis with respect to the rolling-shutter box;

a second structure for containing the rotation means indicated hereinbelow in the present description with the expression "lateral profile", the rolling-shutter box and the lateral profile being mutually connectable, the shaft and the rotation means being mutually connected when the rolling-shutter box and the lateral profile are mutually connected, wherein, according to the invention, the system comprises means for preventing a rotation of the shaft around said axis when the shaft is not connected to the rotation means, the prevention means (also indicated as blocking means) comprising:

at least one first pin connected to the shaft in a manner such that a rotation of the shaft around said axis involves a rotation of the first pin around said axis, and vice versa;

a first seat for housing the first pin integrally connected to the rolling-shutter box, the first pin being movable between at least one third position at which the first pin is housed, at least partially, in the first seat, and a fourth position at which the first pin is not housed in the first seat, the first pin being in the third position when the rolling-shutter box and the lateral profile are not mutually connected;

the first seat being shaped in a manner such that the first pin prevents the shaft from rotating around said axis when the first pin is in the third position, the first pin allowing the shaft to rotate around said axis when the first pin is in the fourth position;

means for guiding the first pin between the third position and the fourth position, the guide means being connected to the shaft;

means suitable for maintaining the first pin in the third position and indicated hereinbelow in the present description with the expression "maintenance means";

means suitable for expelling the first pin from the first seat and indicated hereinbelow in the present description with the expression "ejection means", the ejection means being connected to the lateral profile, a mutual connection between the rolling-shutter box and the lateral profile causing a prevalence of the ejection means over the maintenance means and consequently a movement of the first pin from the third position to the fourth position, the first pin being in the fourth position when the rolling-shutter box and the lateral profile are mutually connected.

While the rolling-shutter box and the lateral profile are disconnected from each other, the first pin is maintained in the first seat by the maintenance means, thus preventing a rotation of the shaft and hence a movement of the prevention means. When the rolling-shutter box and the lateral profile are mutually connected, the ejection means prevail over the maintenance means, obliging the first pin to exit outward from the first seat, thus allowing a rotation of the shaft and hence a movement of the prevention means.

Further innovative characteristics of the present invention are described in the dependent claims.

According to one aspect of the invention, the system comprises at least one first plate (indicated hereinbelow in the present description also with the expression "cap"), preferably flat, integrally connected to the rolling-shutter box and including at least one first through hole acting as said first seat, the first pin being housed, at least partially, in the first hole when the first pin is in the third position, the ejection means comprising at least one second pin integrally connected to the lateral profile, the second pin being housable, at least partially, in the first hole, the first hole being penetratable by the first pin and by the second pin respectively on opposite sides with respect to a plane on which the first plate lies, a mutual connection between the rolling-shutter box and the lateral profile causing a penetration of the second pin into the first hole, pushing the first pin from the third position to the fourth position, the second pin thus being opposed to the maintenance means and prevailing thereon, the second pin being housed in the first hole when the rolling-shutter box and the lateral profile are mutually connected.

The second pin therefore acts as a counter-pin that pushes the first pin outward from the first hole when the rolling-shutter box is connected to the lateral profile. According to another aspect of the invention, the first pin can be fit in the first hole, the maintenance means consisting of friction between the first pin and a wall of the first hole with which the first pin is in contact when the first pin is in the third position, a penetration of the second pin into the first hole pushing the first pin from the third position to the fourth position, the second pin thus overcoming said friction.

According to another aspect of the invention, the maintenance means comprise elastic means suitable for maintaining the first pin in the third position, a penetration of the second pin in the first hole pushing the first pin from the third position to the fourth position, the second pin thus being opposed to the elastic means and prevailing over these.

According to another aspect of the invention, the system comprises first means for blocking the first pin in the fourth position when the rolling-shutter box and the lateral profile are mutually connected.

According to another aspect of the invention, the guide means act a means for connecting the first pin to the shaft and are suitable for allowing a translation of the first pin parallel to the rotation axis of the shaft, the first pin therefore being rotatable, together with the shaft, around said rotation axis, the first plate including at least one circular crown acting as said first blocking means, the circular crown having a symmetry axis preferably orthogonal to the first plate and preferably coinciding with the rotation axis of the shaft.

The first plate is shaped like a circular crown or it is a flat element having a form including a circular crown, i.e. having a form such that, by removing one or more portions from said flat element, it is possible to obtain—starting from the latter—a circular crown. The radius of the circular crown substantially corresponds with the distance between the first pin and the rotation axis of the shaft. Advantageously, due to the presence of the circular crown, once the assembly of the system has terminated, the first pin no longer has any degree of translational freedom and can only rotate, together with the shaft, around the rotation axis thereof when a movement of the separation means is commanded. In such a manner, there is no risk that the first pin can undesirably interfere with a rotation of the shaft when a movement of the separation means is commanded. According to another aspect of the invention, the rotation means comprise a third pin preferably arranged parallel to the shaft, the shaft comprising a second seat for housing the third pin, a housing of the third pin in the second seat connecting the shaft to the rotation means, a connection of the rolling-shutter box to the lateral profile causing a housing of the third pin in the second seat, the third pin traversing the circular crown along said symmetry axis when the third pin is housed in the second seat.

According to another aspect of the invention, the guide means comprise at least one second plate including at least one second through hole, the shaft traversing the second plate at the second hole, the second plate being translatable on the shaft, the first pin being integrally connected to the second plate.

According to another aspect of the invention, the elastic means comprise a helical spring compressed between the second plate and a stop integrally connected to the shaft and lying on the side opposite the first plate with respect to the second plate.

According to another aspect of the invention, the command means are movable between at least one fifth position at which, when the shaft and the rotation means are mutually connected, the separation means are in the first position, and a sixth position at which, when the shaft and the rotation means are mutually connected, the separation means are in the second position, a movement of the command means between the fifth position and the sixth position causing the actuation of the rotation means, the system comprising second means for blocking the command means in the sixth position, a removal of the command means from the sixth position being performable by a user of the system by overcoming the second blocking means. With reference, by way of example, to a system comprising a Venetian blind whose slats are vertically translatable, when the connection between the shaft and the rotation means is obtained, as mentioned above, the command means must usually be in the position corresponding to the configuration in which the blind is completely raised (i.e. they must be in the sixth position).

Advantageously, due to the presence of the second blocking means, before the rotation means are connected to the shaft, the command means are prevented from being undesirably moved away from the sixth position due for example to the manipulations sustained by the components of the system during the assembly thereof.

In addition thereto, once the assembly of the system has terminated, the second blocking means contribute to preventing an undesired movement of the separation means from the second position to the first position (i.e., with reference to the abovementioned Venetian blind closure system, a lowering of the blind) due to the weight force acting on the separation means.

According to another aspect of the invention, the command means comprise a slider translatable between the fifth position and the sixth position, the second blocking means comprising:

at least one first stop tooth integrally connected to a first tongue that is elastically deformable and integrally connected to the slider;

a third seat for housing the first stop tooth, the first tooth being housed in the third seat when the slider is in the sixth position, a housing of the first tooth in the third seat blocking the slider in the sixth position, a removal of the slider from the sixth position able to occur only together with an elastic deformation of the first tongue to an extent such to cause an exit of the first tooth from the third seat, the user of the system, in order to overcome the second blocking means, having to apply to the slider a translating force of sufficient size for elastically deforming the first tongue, so as to cause an exit of the first tooth from the third seat.

According to another aspect of the invention, the system comprises third means for blocking the command means in the fifth position, a removal of the command means from the fifth position being performable by a user of the system by overcoming the third blocking means.

According to another aspect of the invention, the third blocking means comprising:

a fourth seat for housing the first tooth, the first tooth being housed in the fourth seat when the slider is in the fifth position, a housing of the first tooth in the fourth seat blocking the slider in the fifth position, a removal of the slider from the fifth position only able to occur together with an elastic deformation of the first tongue of size such to cause the exit of the first tooth from the fourth seat, the user of the system, in order to overcome the third blocking means, having to apply to the slider a translating force of sufficient size for elastically deforming the first tongue, so as to cause an exit of the first tooth from the fourth seat. According to another aspect of the invention, the third blocking means comprising:

at least one second stop tooth integrally connected to a second tongue that is elastically deformable and integrally connected to the slider;

a fifth seat for housing the second tooth, the second tooth being housed in the fifth seat when the slider is in the fifth position, a housing of the second tooth in the fifth seat blocking the slider in the fifth position, a removal of the slider from the fifth position only able to occur together with an elastic deformation of the second tongue of size such to cause the exit of the second tooth from the fifth seat, the user of the system, in order to overcome the third blocking means, having to apply to the slider a translating force of sufficient size for elastically deforming the second tongue, so as to cause an exit of the second tooth from the fifth seat.

BRIEF DESCRIPTION OF THE FIGURES

Further objects and advantages of the present invention will be clearer from the following detailed description of an embodiment thereof and from the enclosed drawings, given as a merely non-limiting example, in which.

DETAILED DESCRIPTION OF SEVERAL PREFERRED EMBODIMENTS OF THE INVENTION

In the present description, in order to facilitate the exposition, reference is only made to a preferred embodiment of the invention, in which the closure system, subject of the invention, comprises a Venetian blind housed within a double glazing. It must be clear that the invention is not limited to the aforesaid embodiment but can be applied to any closure system whose movement group comprises:

a member rotatable around an axis and connected to the separation means in a manner such that a rotation of the member rotatable around said axis causes a movement of the separation means, and means for rotating of the member rotatable around said axis.

By way of example, the separation means, in addition to a Venetian blind, can be a pleated blind or a shutter blind. They can also be a movable screen comprised between two glass panes forming a wall.

Hereinbelow in the present description, a figure can be illustrated also with reference to elements not expressly indicated in that figure but in other figures. The scale and proportions of the various depicted elements do not necessarily correspond to the actual scale and proportions.

Figure 1:
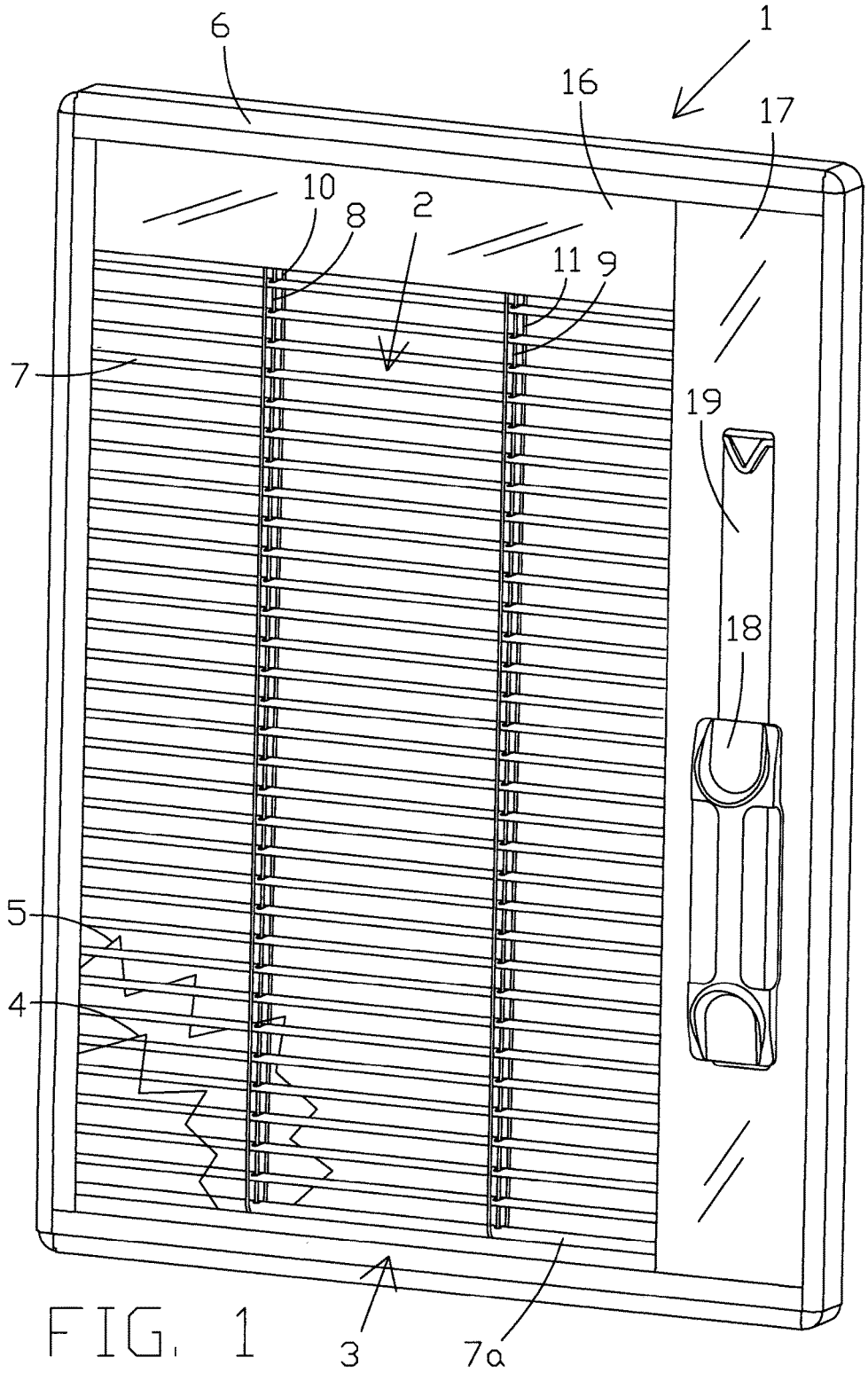
FIG. 1 shows, in perspective view, a closure system comprising a Venetian blind housed in a double glazing, according to the present invention.

FIG. 1 shows a closure system 1 comprising a Venetian blind 2 housed in a structure 3 known as a "double glazing". The double glazing 3 comprises two glass panes 4 and 5 preferably mutually parallel and sustained by a frame 6 partially interposed thereto. By way of example, the glass panes 4 and 5 are vertically arranged and the frame 6 is metallic. Incidentally, the latter can also be made of other materials, for example plastic or rubber materials. The glass panes 4 and 5 delimit, together with the frame 6, a parallelepiped chamber within which the blind 2 is housed. The latter comprises a multiplicity of elements 7 extended lengthwise, mutually parallel and indicated hereinbelow in the present description with the expression "slats". The slats 7 are arranged, by way of example, horizontally and are movable with respect to the double glazing 3. In particular, the closure system 1 comprises a movement group by means of which it is possible to impart to the slats 7 both a translational motion parallel to the glass panes 4 and 5 (due to which one obtains what is usually indicated as "lowering" or "raising" of the blind 2), and a rotary motion around a respective longitudinal axis (due to which the orientation of the slats 7 with respect to the double glazing 3 is modified).

The movement group comprises a shaft 15 (visible in FIG. 4) preferably arranged parallel to the slats 7 and rotatable around a longitudinal axis thereof. The shaft 15 is housed in a first containment structure 16 (visible in FIG. 2) placed at an upper portion of the closure system 1. The containment structure 16 will be indicated hereinbelow in the present description with the expression "rolling-shutter box". The shaft 15 is connected to the slats 7 in a manner such that a rotation of the shaft 15 causes a translation and/or a rotation of the slats 7.

The translation of the slats 7 occurs by means of a pair of cords 8 and 9 arranged vertically, by way of example, and each of which transversely crosses the slats 7 at a respective hole. The slats 7 thus comprise two vertical sequences of holes, each of which crossed by one of the two cords 8 and 9. The latter are integrally connected, at a first end, with the shaft 15, and at a second end opposite the first end, with the slat which, in the group of slats 7, is placed at the lowest elevation in the figures. This slat will be indicated hereinbelow in the present description with the reference number 7*a* and will be termed "bottom" slat. The rotation of the shaft 15 around the longitudinal axis thereof causes a winding or unwinding of the cords 8 and 9 around the shaft 15 and consequently a raising or a lowering of the blind 2.

The rotation of the slats 7 occurs by means of two cords 10 and 11 arranged vertically, by way of example. Each cord 10 and 11 is bent like a U and is partially wound, at the base of the U, around a respective pulley fit coaxial with the shaft 15 and freely rotating with respect thereto. Each cord 10 and 11 is connected, transversely and at each arm of the U, to the slats 7 along a respective longitudinal edge thereof. Hereinbelow in the present description, the cords 10 and 11 will be indicated with the expression "ladder-like cords". A rotation of the pulleys around the longitudinal axis thereof consequently causes a translation of the ladder-like cords 10 and 11. Thus, each slat 7 rotates around the longitudinal axis thereof. The amplitude of the rotation, with respect to the horizontal position, is preferably comprised between +70° and −70°.

A rotation of the shaft 15 around the longitudinal axis thereof can initially cause a rotation of the slats 7 but will subsequently only cause the translation thereof. Given that the cords 8 and 9, the ladder-like cords 10 and 11, and the connection of these to the shaft 15 are substantially known, further details are not provided thereon hereinbelow.

The movement group of the closure system 1 further comprises a mechanism connected to the shaft 15 in a manner such that the actuation of said mechanism causes a rotation of the shaft 15 around the longitudinal axis thereof. The rotation mechanism of the shaft 15 is housed in a second containment structure 17 placed at a lateral portion of the closure system 1. The containment structure 17 will be indicated hereinbelow in the present description with the expression "lateral profile".

The rotation mechanism of the shaft 15 comprises, by way of example, a belt having two mutually connected ends to form a ring maintained under tension by a pair of coplanar pulleys, around each of which the belt is wound for a section equal to half a circumference. The pulleys are preferably arranged in a manner such that the two belt sections that join the same are vertically arranged. The pulleys have a groove whose width is slightly less than the width of the belt wound around the same, and the tension at which the belt is maintained is such to force the latter within the groove. This ensures that the belt is integrally connected to the pulleys at the section where the belt is in contact therewith. By applying a force at one of the two belt sections that join the pulleys, a torque is generated that tends to rotate the pulleys. Such torque is transmitted to the shaft 15 by means of a system of gears 12 (visible in FIG. 3) so as to cause a rotation of the shaft 15 around the longitudinal axis thereof and consequently a rotation and translation of the slats 7. Incidentally, in the abovementioned rotation mechanism of the shaft 15, as an alternative to the belt it is possible to employ another flexible member extended lengthwise, such as a cord or a chain. In the latter case, the pulleys are toothed wheels.

Given that the rotation mechanism of the shaft 15 is substantially known, further details are not provided hereinbelow.

The closure system 1 further comprises a slider 18 with nearly parallelepiped shape, by way of example, and placed outside the double glazing 3 and translatable along a guide 19 integrally connected to the glass pane 4 at the lateral profile 17. Preferably, the guide 19 is vertically arranged and the slider 18 is therefore vertically translatable on the lateral profile 17. The slider 18 is magnetically coupled to a slide, within the lateral profile 17, integrally connected to the belt at one of the two belt sections that join the coplanar pulleys of the rotation mechanism of the shaft 15. A translation of the slider 18 on the guide 19 determines a corresponding vertical translation of the slide within the lateral profile 17 (hence a rotation of the belt and with this, as stated above, a rotation of the shaft 15 around the longitudinal axis thereof). A user of the closure system 1, in order to command a translation or a rotation of the slats 7, thus grasps the slider 18 and translates it along the guide 19. In the configuration shown in FIG. 1, the slider 18 is at the lower end stop and the blind 2 is completely lowered.

Figure 2:
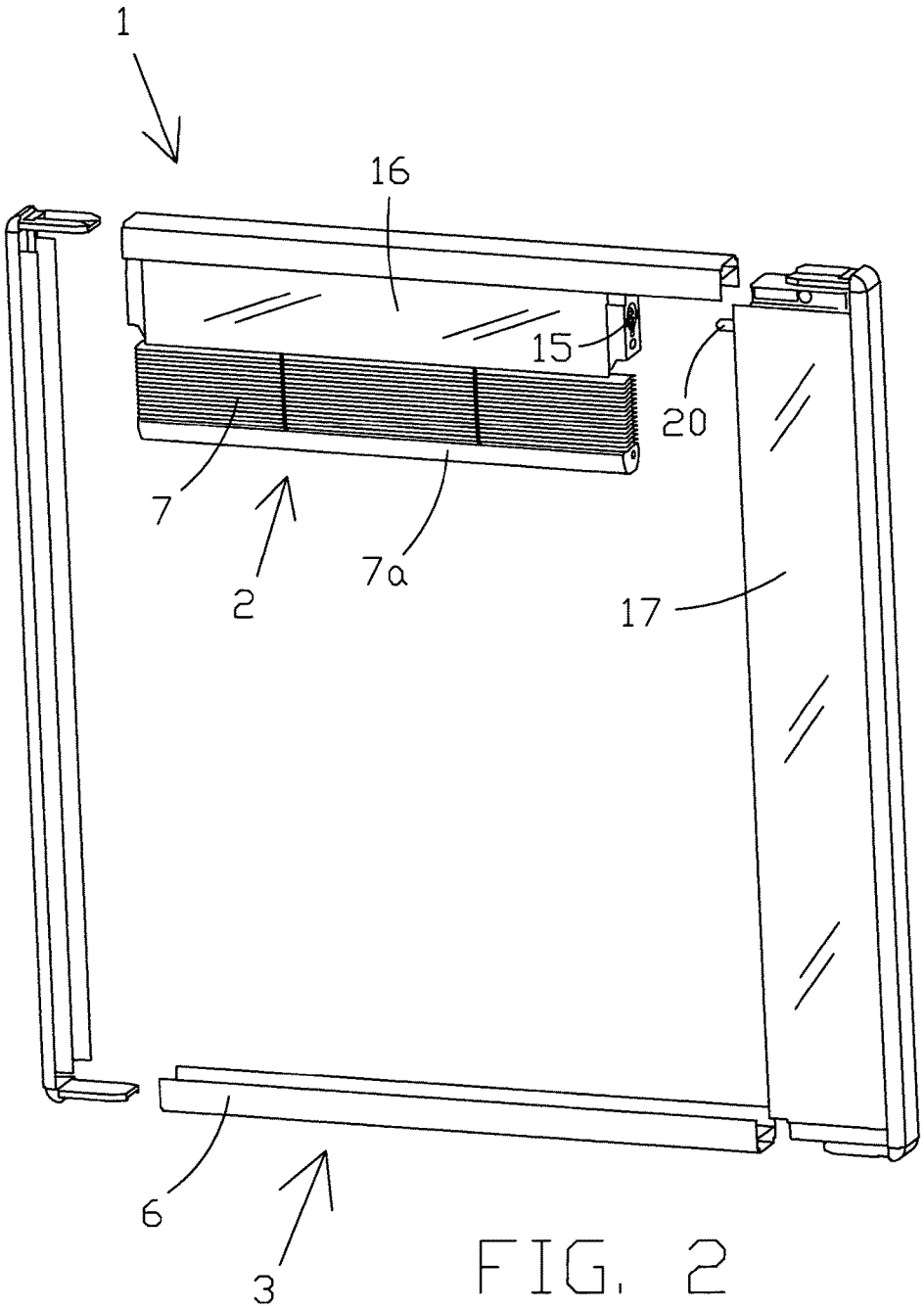
FIG. 2 shows several components of the closure system of FIG. 1, in exploded perspective view.

FIG. 2 shows the closure system 1 in a partially exploded view where, for the sake of simplicity, the slider 18 and the guide 19 have been omitted. The rolling-shutter box 16 and the lateral profile 17 are mutually disconnected and, due to this disconnection, it is possible to observe a pin 20 (better visible in FIG. 3) orthogonally projecting from the lateral profile 17 towards the rolling-shutter box 16. The pin 20 is connected to the gear system 12 of the rotation mechanism of the shaft 15 (as will be better described with reference to FIG. 3) and is housable in a suitable seat 21 (better visible in FIG. 4) obtained longitudinally in the shaft 15. The rolling-shutter box 16 and the lateral profile 17 are mutually disconnected at a distance such that the pin 20 lies completely outside the seat 21. In the configuration shown in FIG. 2, the blind 2 is completely raised (hence, the slider 18, not illustrated, is at the upper end stop).

As will be better described hereinbelow, the connection of the rolling-shutter box 16 to the lateral profile 17 during the assembly of the closure system 1 causes the housing of the pin 20 in the seat 21 and, consequently, the connection between the shaft 15 and the rotation mechanism thereof.

Figure 3:
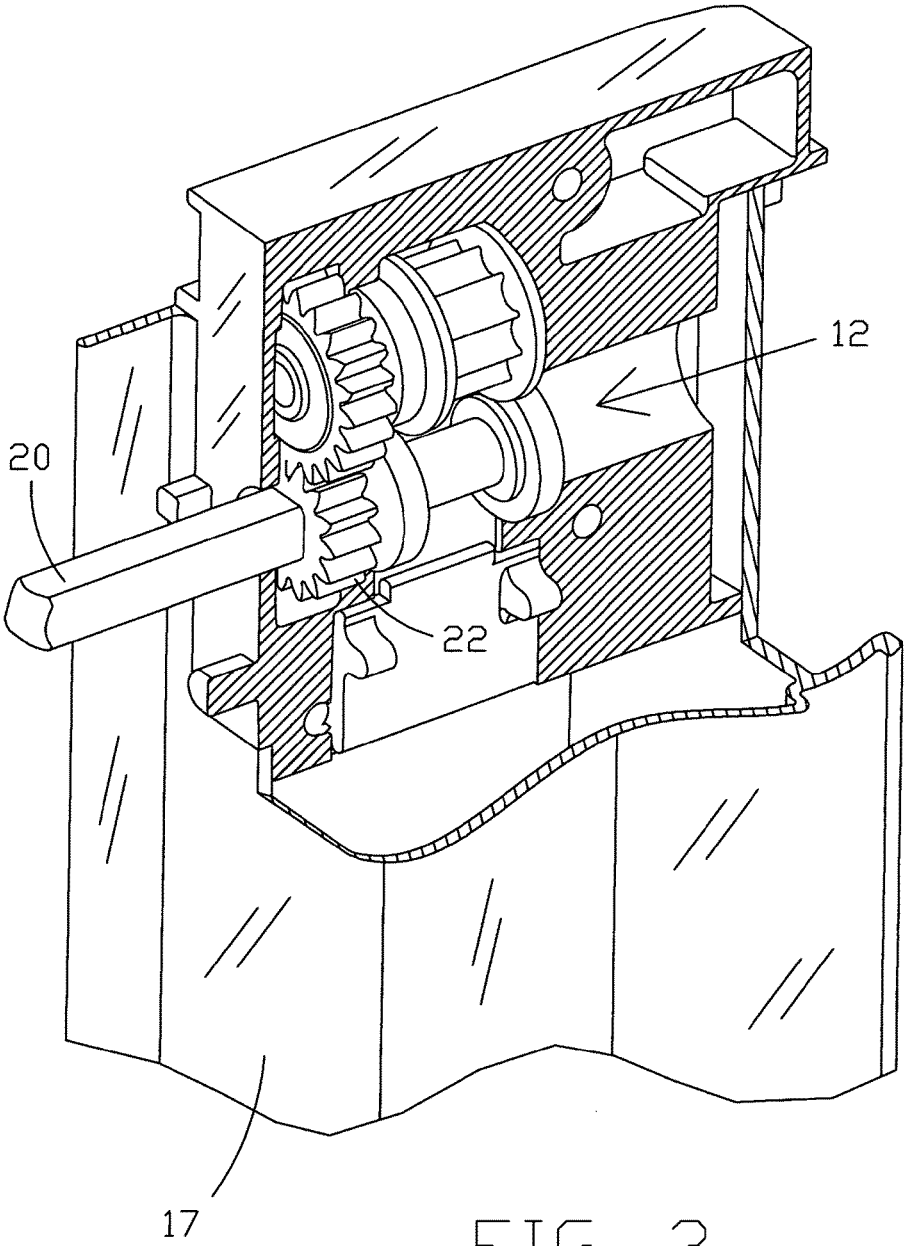
FIG. 3 shows several components of a group for moving the blind of the system of FIG. 1, in schematic, partial cross section.
Figure 4:
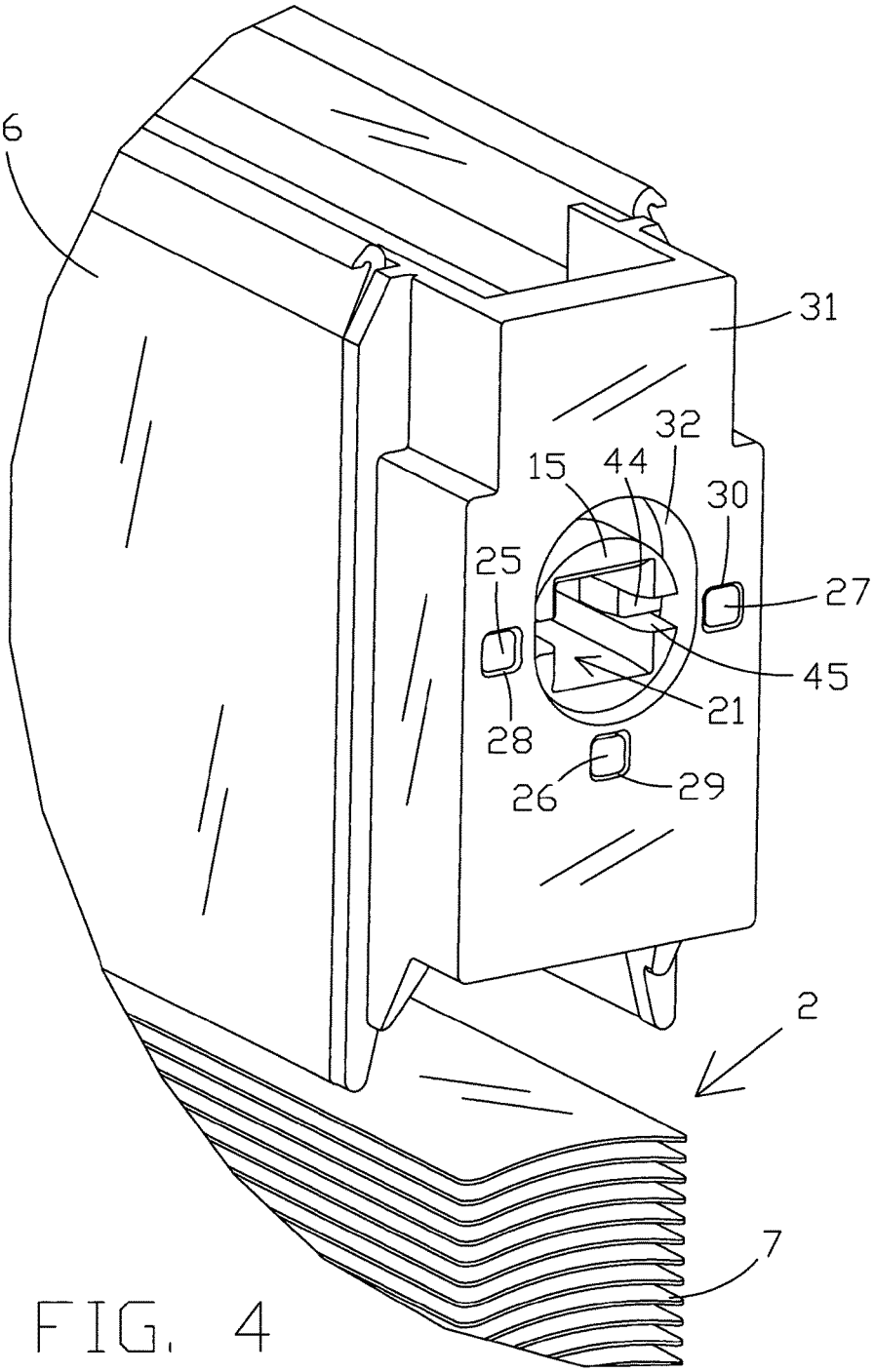
FIG. 4 shows, in perspective view, a detail of a rolling-shutter box of the closure system of FIG. 1, in an instant in which the rolling-shutter box and a lateral profile of the system of FIG. 1 are disconnected from each other.

With reference to FIG. 3, it is possible to observe that the pin 20 has a preferably polygonal cross section, and still more preferably square cross section. The pin 20 is integrally connected with a toothed wheel 22 that is part of the gear system 12 actuated by the slider 18 by means of the belt within the lateral profile 17. The pin 20 is preferably arranged with a longitudinal axis thereof coinciding with the rotation axis of the toothed wheel 22. A translation of the slider 18 therefore causes a rotation of the pin 20 around the longitudinal axis thereof. With reference to FIG. 4, it is possible to observe that the seat 21 made in the shaft 15 has a transverse cross section nearly identical to that of the pin 20. In order to connect the lateral profile 17 to the rolling-shutter box 16, it is necessary to make the pin 20 penetrate into the seat 21. When the rolling-shutter box 16 and the lateral profile 17 are mutually connected, the pin 20 is therefore housed in the seat 21. Due to this housing, given that the cross section of the pin 20 is polygonal and that the cross section of the seat 21 nearly identical to that of the pin 20, the shaft 15 becomes rotationally integral with the pin 20. In other words, when the rolling-shutter box 16 and the lateral profile 17 are mutually connected, the pin 20 transmits to the shaft 15 the rotation of the toothed wheel 22. In such a manner, a translational motion of the slider 18 is transmitted to the shaft 15 and then to the slats 7. Incidentally, the pin 20, when housed in the seat 21, is arranged parallel to the shaft 15 and, by way of example, is connected to the latter via fitting.

With reference once again to FIG. 4, it is possible to observe that the closure system 1 comprises at least one pin, but preferably three pins 25, 26 and 27 housed in three respective seats 28, 29 and 30 obtained by making three respective through holes in a wall 31 acting, by way of example, as a cap of the rolling-shutter box 16 opposite the lateral profile 17 when the closure system 1 is completely assembled. The cap 31 is therefore integral with the rolling-shutter box 16 and is preferably arranged orthogonal to the shaft 15. The cap 31 comprises a further through hole 32 for allowing the access to the seat 21. Preferably, the shaft 15 at least partially crosses the cap 31 at the hole 32. Incidentally, the transmission pin 20 crosses the cap 31 at the hole 32 when the rolling-shutter box 16 and the lateral profile 17 are mutually connected. Preferably, the hole 32 is circular and the seats 28, 29 and 30 are arranged around the hole 32, preferably, at the same distance from the center thereof. The seats 28, 29 and 30 therefore lie on a portion of the cap 31 identifiable as a circular crown whose central hole corresponds with the hole 32. The rotation axis of the shaft 15 coincides with a symmetry axis of said circular crown arranged orthogonal to the cap 31. The pins 25, 26 and 27 are preferably identical to each other and have a square cross section, by way of example. The seats 28, 29 and 30 preferably have a cross section nearly identical to that of the pins 25, 26 and 27 and, in FIG. 4, are respectively arranged on the sides of and below the hole 32 of the cap 31. In the configuration shown in FIG. 4, in which the rolling-shutter box 16 is disconnected from the lateral profile 17, the pins 25, 26 and 27 are connected to the cap 31 via fitting.

Figure 5:
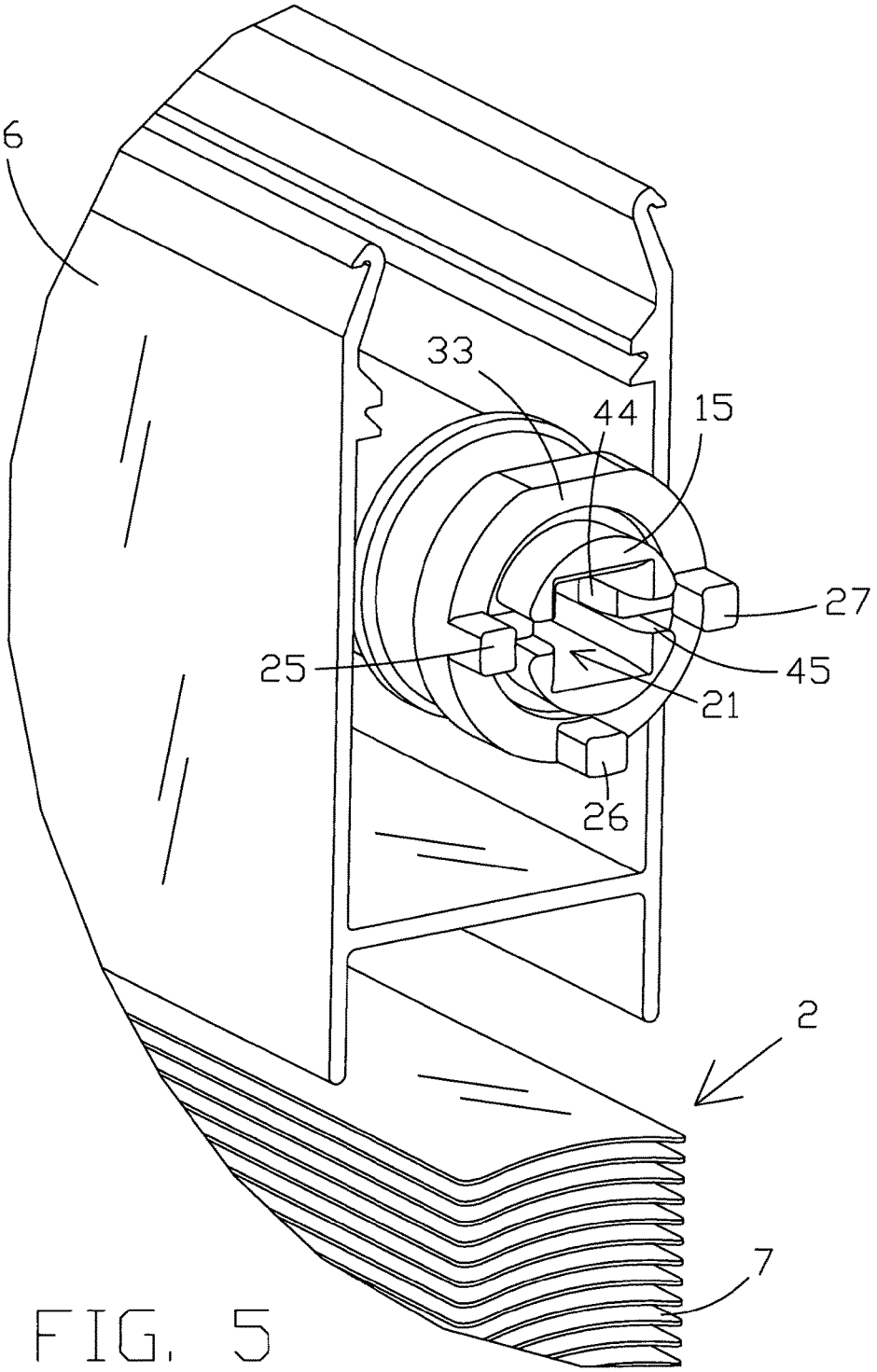
FIG. 5 shows, in perspective view, the detail of FIG. 4 lacking a wall of the rolling-shutter box.
Figure 6:
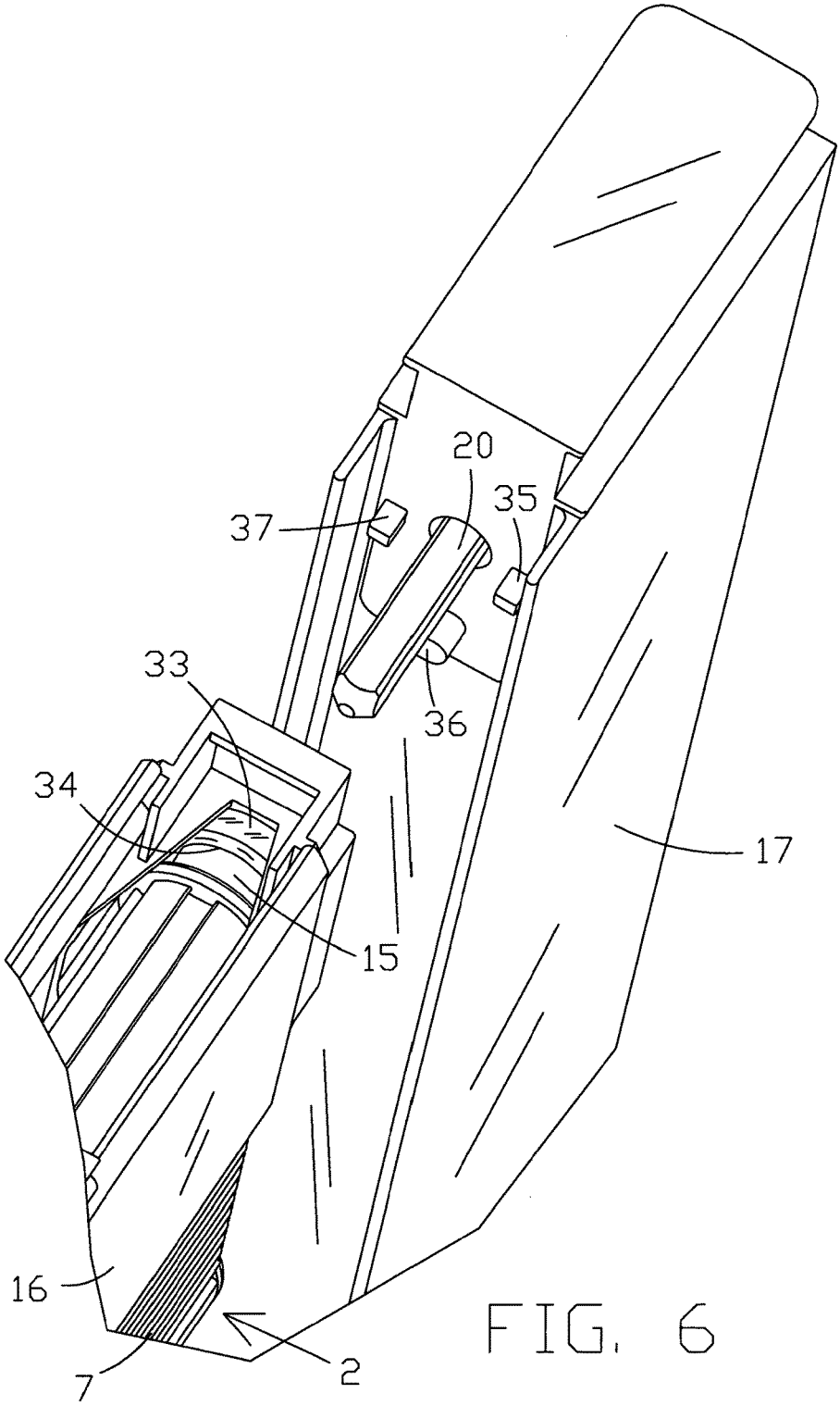
FIG. 6 shows, in top perspective view, the rolling-shutter box and the lateral profile of the closure system of FIG. 1 in an instant that precedes the mutual assembly thereof.

With reference to FIGS. 5 and 6, it is possible to observe that the closure system 1 comprises, within the rolling-shutter box 16, a plate 33 traversed by the shaft 15 at a hole 34 and lying on the side opposite the lateral profile 17 with respect to the cap 31. FIG. 5 differs from FIG. 4 due to the absence of the cap 31, for the purpose of allowing a better observation of the plate 33. Preferably, plate 33 is arranged orthogonal to the shaft 15 and is integrally and orthogonally connected to the pins 25, 26 and 27. The latter are therefore preferably arranged parallel to the shaft 15. The plate 33 is translatable on the shaft 15 but it is rotationally connected thereto. In particular, the plate 33 is, by way of example, shaped as a circular crown and has, at the hole 34, a pair of teeth 44, by way of example diametrically opposed, housed in respective grooves 45 that longitudinally run along the shaft 15. The plate 33 can therefore translate parallel to the rotation axis of the shaft 15 but rotate together with the latter around the longitudinal axis thereof. In the configuration shown in FIGS. 5 and 6, in which the rolling-shutter box 16 is disconnected from the lateral profile 17, the plate 33 is in abutment against the cap 31 and the pins 25, 26 and 27 are fit in the respective seats 28, 29 and 30. In such configuration, the pins 25, 26 and 27 therefore prevent the shaft 15 from rotating around the longitudinal axis thereof. Incidentally, this result can also be obtained if the closure system, subject of the invention, comprises only one of the pins 25, 26 and 27 for preventing the rotation of the shaft 15.

With reference once again to FIGS. 5 and 6, it is possible to observe that the closure system 1 comprises three counter-pins 35, 36 and 37 integrally connected to the lateral profile 17 and projecting therefrom preferably parallel to the transmission pin 20. The counter-pins 35, 36 and 37 are, preferably, nearly identical to the pins 25, 26 and 27 and are housable in the seats 28, 29 and 30. In particular, the counter-pins 35, 36 and 37 are arranged around the pin 20 in a manner such that, with the connection of the lateral profile 17 to the rolling-shutter box 16, while the pin 20 penetrates into the seat 21, the counter-pins 35, 36 and 37 penetrate into the seats 28, 29 and 30 pushing the pins 25, 26 and 27 outside the latter, towards the interior of the rolling-shutter box 16. The cap 31 is therefore penetratable from opposite sides, at the seats 28, 29 and 30, respectively by the pins 25, 26 and 27 and by the counter-pins 35, 36 and 37. The plate 33 also acts as translation guide for the pins 25, 26 and 27 parallel to the rotation axis of the shaft 15. Given that the pins 25, 26 and 27 are fit in the seats 28, 29 and 30 when the rolling-shutter box 16 and the lateral profile 17 are mutually disconnected, in order to connect the lateral profile 17 to the rolling-shutter box 16 it is necessary to apply a force of size such to overcome both the static friction that maintains the pins 25, 26 and 27 in the seats 28, 29 and 30, and the possible sliding friction that opposes the entrance of the counter-pins 35, 36 and 37 in the seats 28, 29 and 30.

Figure 7:
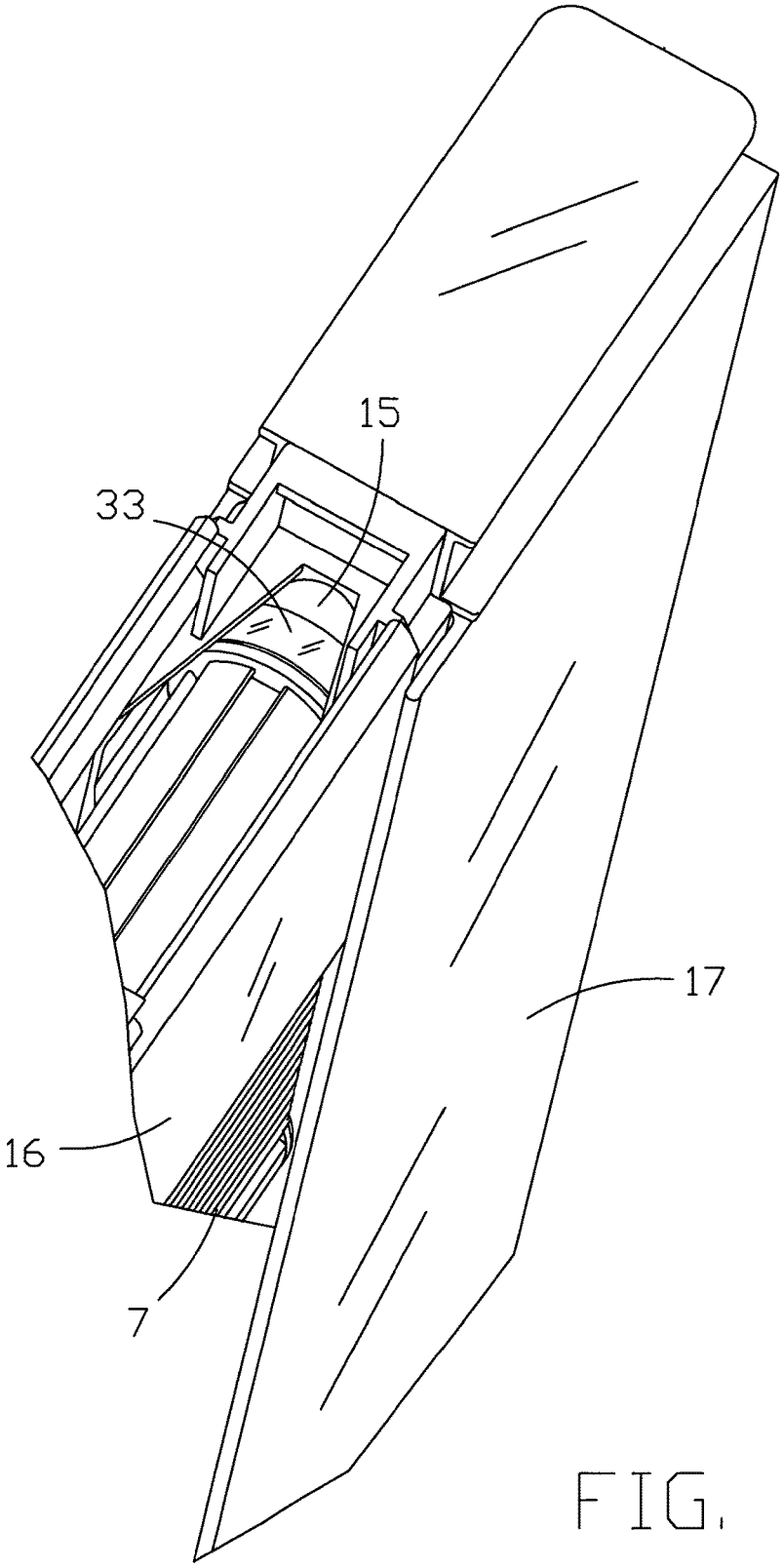
FIG. 7 shows, in top perspective view, the rolling-shutter box and the lateral profile of the closure system of FIG. 1 assembled to each other.
Figure 8:
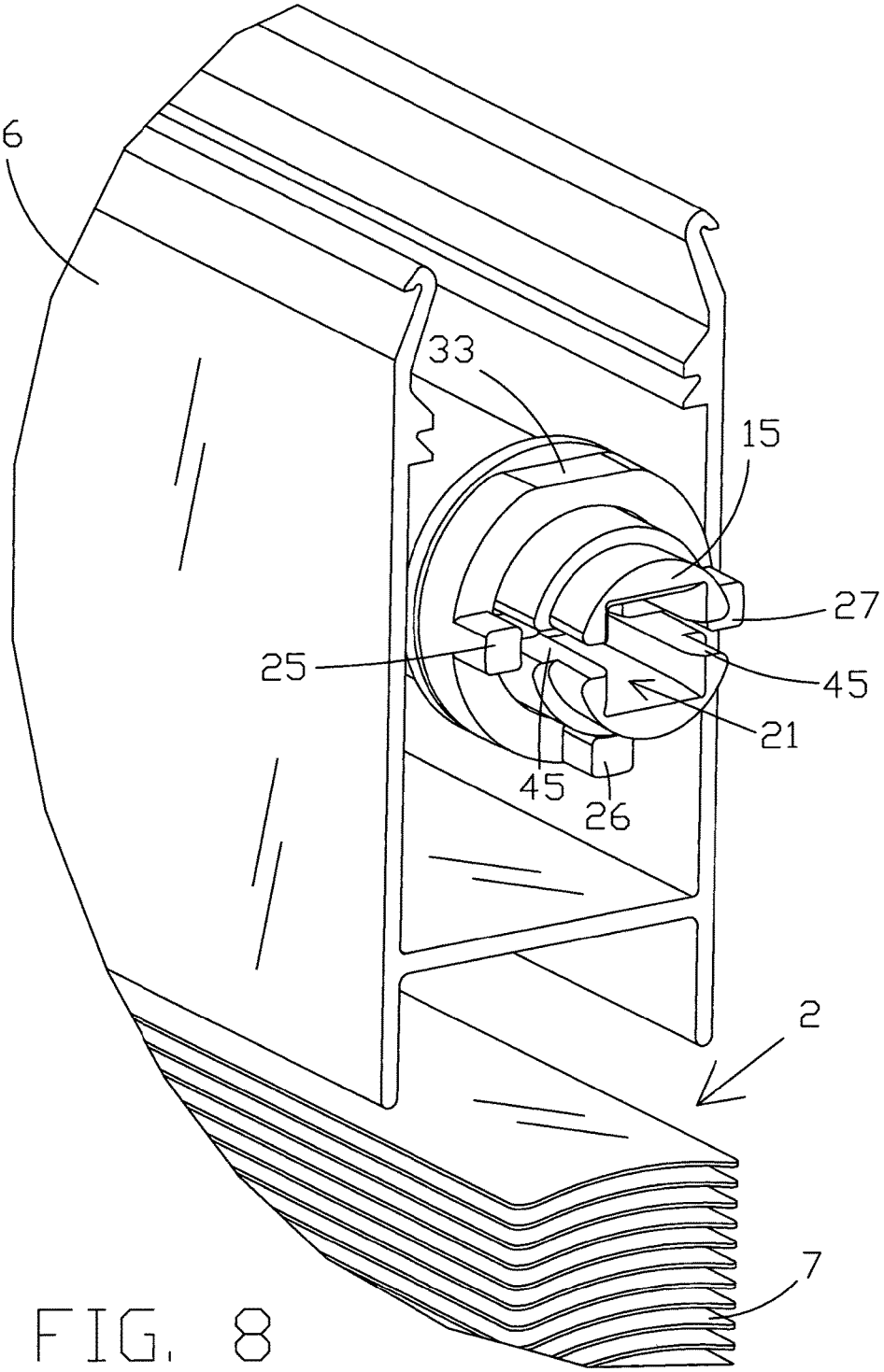
FIG. 8 shows, in perspective view, the detail of FIG. 4 in an instant in which the rolling-shutter box and the lateral profile are assembled together.

With reference to FIGS. 7 and 8, which show the closure system 1 completely assembled (i.e. with the rolling-shutter box 16 and the lateral profile 17 mutually connected), it is possible to observe that the exit of the pins 25, 26 and 27 from the seats 28, 29 and 30 has caused the moving away of the plate 33 from the cap 31. In this configuration, the plate 33 is free to rotate integrally with the shaft 15 around the longitudinal axis thereof.

In summary, when the rolling-shutter box 16 and the lateral profile 17 are mutually disconnected (as shown in FIGS. 2 to 5), the pins 25, 26 and 27 are fit in the seats 28, 29 and 30 so as to prevent a rotation of the shaft 15 and consequently a movement of the slats 7.

When the rolling-shutter box 16 and the lateral profile 17 are mutually connected (as shown in FIGS. 1 and 6), the counter-pins 35, 36 and 37 are housed in the seats 28, 29 and 30 in a manner such that the pins 25, 26 and 27 are completely expelled from the latter, so as to allow a rotation of the shaft 15 and consequently a movement of the slats 7.

When the rolling-shutter box 16 and the lateral profile 17 are mutually connected, since the seats 28, 29 and 30 are occupied by the counter-pins 35, 36 and 37 and lie on a circular crown included in the cap 31, the pins 25, 26 and 27 are obliged to lie outside the seats 28, 29 and 30.

In an alternative embodiment of the closure system, subject of the invention, not shown in the figures, the closure system comprises a spring compressed between the plate 33 and a stop integrally connected to the rolling-shutter box 16 and lying on the side opposite the cap 31 with respect to the plate 33. In this embodiment, in addition or as an alternative to the fitting, the spring maintains the pins 25, 26 and 27 in the seats 28, 29 and 30 when the rolling-shutter box 16 and the lateral profile 17 are mutually disconnected. In order to connect the lateral profile 17 to the rolling-shutter box 16, it is therefore necessary to apply a force of size such to further compress the spring (beyond or in addition to overcoming both the static friction that maintains the pins 25, 26 and 27 in their seats 28, 29 and 30, and the possible sliding friction that opposes the entrance of the counter-pins 35, 36 and 37 in the seats 28, 29 and 30).

Figure 9:
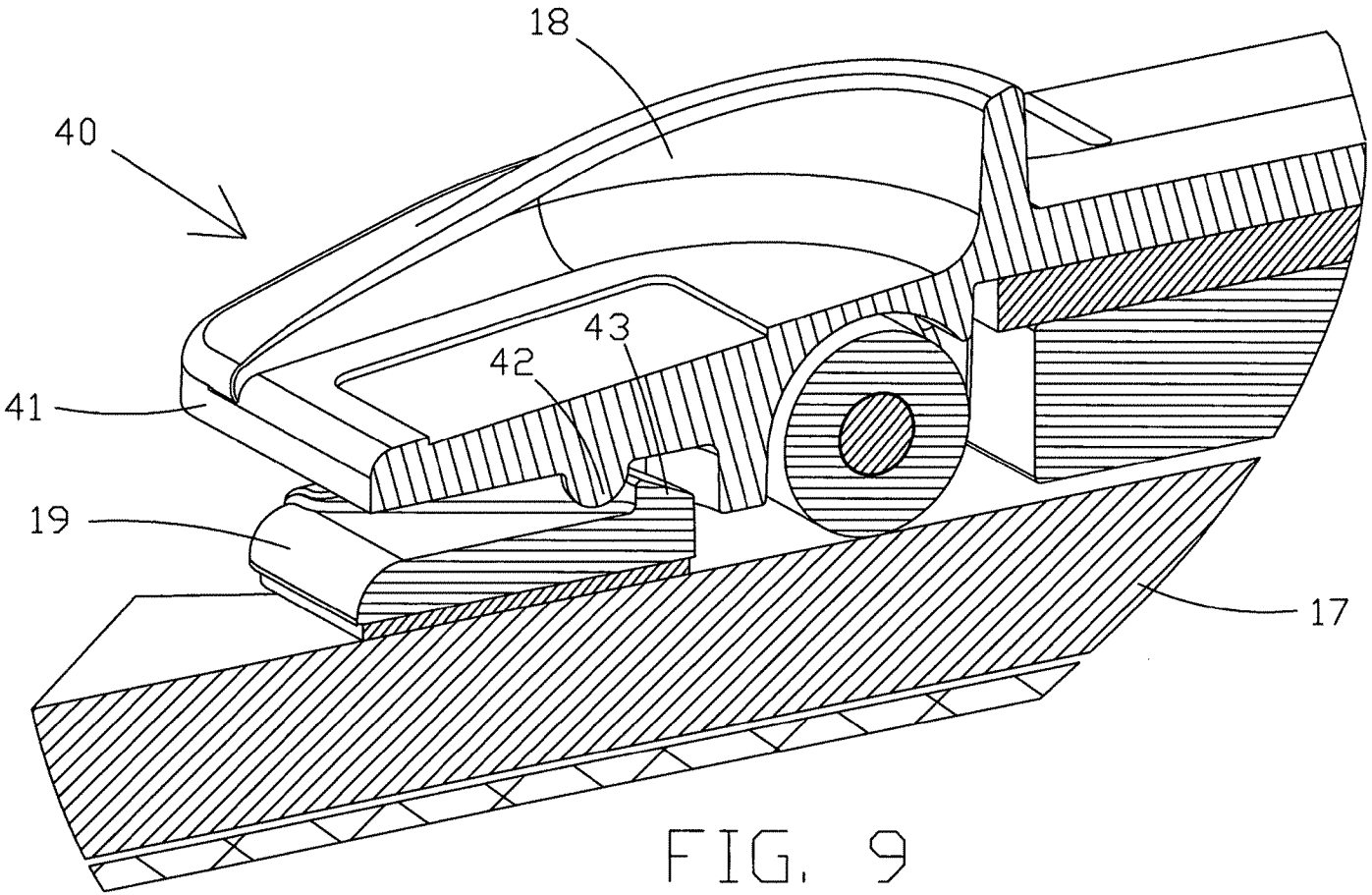
FIG. 9 shows, in schematic cross section, a detail of a slider for commanding the movement of the blind of the system of FIG. 1.

With reference to FIG. 9, it is possible to observe that the slider 18, at an end 40 that is situated at an end stop (upper end stop, in the figures) when the blind 2 is completely raised, comprises a tongue 41 preferably arranged parallel to the guide 19 and elastically deformable. A stop tooth 42 is integrally connected to the tongue 41 so as to project, by way of example, towards the guide 19. The closure system 1 further comprises, at the lateral profile 17, a stop 43 against which the tooth 42 is in abutment when the slider 18 is at the upper end stop. In particular, the stop 43 is, by way of example, an edge that sufficiently projects from the lateral profile 17 to intercept the tooth 42 when the slider 18 tends to move away from the upper end stop. The stop 43 delimits a seat for housing the tooth 42. The tongue 41, the tooth 42 and the stop 43 act as means for blocking the slider 18 when the latter is situated at the upper end stop, i.e. when the blind 2 is completely raised. When a user of the closure system 1 must translate the slider 18 towards the lower end stop (i.e. when he must completely lower the blind 2) starting from a configuration in which the blind 2 is completely raised, he must apply to the slider 18 a force of size such to elastically bend the tongue 41, so as to make the tooth 42 go beyond the stop 43. Analogously, when a user of the closure system 1 must translate the slider 18, bringing it to the upper end stop (i.e. when he must completely raise the blind), he must apply a force to the slider 18 of size such to elastically bend the tongue 41 so as to make the tooth 42 go beyond the stop 43 and to bring the tooth 42 into the position shown in FIG. 2.

The stop 43 is preferably arranged in a manner so as to be visible by a user of the closure system 1. Advantageously, when the user translates the slider 18 towards the upper end stop, he can consciously slow the translation of the slider as the latter approaches the upper end stop, so as to prevent sudden impacts that could cause the separation of the slider 18 from the guide 19 and/or the damaging of other components of the closure system 1, such as the rotation mechanism of the shaft 15.

In an alternative embodiment of the closure system, subject of the invention, not shown in the figures, the closure system comprises a second stop against which the tooth 42 is in abutment when the slider 18 is at the lower end stop. In particular, the second stop is, by way of example, an edge that sufficiently projects from the lateral profile 17 to intercept the tooth 42 when the slider 18 tends to move away from the lower end stop. The second stop delimits a seat for housing the tooth 42. The second stop, together with the tongue 41 and the tooth 42, and in a manner equivalent to the stop 43, acts as means for blocking the slider 18 when the latter is situated at the lower end stop, i.e. when the blind 2 is completely lowered. When a user of the closure system 1 must translate the slider 18 towards the upper end stop (i.e. when he must completely raise the blind 2) starting from a configuration in which the blind 2 is completely lowered, he must apply to the slider 18 a force of size such to elastically bend the tongue 41 such that the second stop goes beyond the tooth 42. Analogously, when a user of the closure system 1 must translate the slider 18, bringing it to the lower end stop (i.e. when he must completely lower the blind), he must apply to the slider 18 a force of size such to elastically bend the tongue 41, such that the tooth 42 goes beyond the second stop and such tooth is brought into the position shown in FIG. 1.

Analogously to that stated for the stop 43, also the second stop is preferably arranged in a manner so as to be visible by a user of the closure system 1.

In an alternative embodiment of the closure system, subject of the invention, not shown in the figures, the closure system comprises: a second tongue that is elastically deformable and placed at an end of the slider that is situated at the lower end stop when the blind 2 is completely lowered; a second stop tooth integrally connected with the second tongue so as to project, by way of example, towards the guide 19; and a third stop against which the second tooth is in abutment when the slider 18 is at the lower end stop. The second tongue, the second stop tooth and the third stop constitute, in a manner equivalent to the tongue 41, the tooth 42 and the stop 43, a system for blocking the slider 18 when the latter is situated at the lower end stop, i.e. when the blind 2 is completely lowered. When a user of the closure system 1 must translate the slider 18 towards the upper end stop (i.e. when he must completely raise the blind 2) starting from a configuration in which the blind 2 is completely lowered, he must apply to the slider 18 a force of size such to elastically bend the tongue 41, such that the tooth 42 goes beyond the third stop. Analogously, when a user of the closure system 1 must translate the slider 18, bringing it to the lower end stop (i.e. when he must completely lower the blind), he must apply to the slider 18 a force of such size to elastically bend the tongue 41 so as to make the tooth 42 go beyond the third stop and to bring the tooth into the position shown in FIG. 1.

Analogous to that stated for the stop 43, also the third stop is preferably arranged in a manner so as to be visible by a user of the closure system 1.

On the basis of the description provided for a preferred embodiment, it is clear that some changes can be introduced by the man skilled in the art without departing from the scope of the invention as defined by the following claims.

The invention claimed is:

1. A system (1) for opening and closing a communication path between two separate environments, said system comprising:

separation means (2, 7) respectively suitable for allowing and preventing, at least partially, the traversing of said path by light, air, or sound waves;

a group (12, 15, 20, 22) for moving said separation means (2, 7) between at least one first open position and one second closed position of said path;

said movement group (12, 15, 20, 22) comprising:

a shaft (15) rotatable around an axis and connected to said separation means (2, 7), said connection causing the movement of said separation means (2, 7);

means (12, 20, 22) for rotating said shaft (15) around said axis, means (18, 19) for commanding said rotation means (12, 15, 20, 22);

a rolling-shutter box (16) for containing said shaft (15);

a lateral profile (17) for containing said rotation (12, 20, 22) and command (18, 19) means, said rolling-shutter box (16) and said lateral profile (17) being mutually connectable, said shaft (15) and said rotation means (12, 20, 22) being mutually connected when said rolling-shutter box (16) and said lateral profile (17) are mutually connected, said system (1) being characterized in that it comprises means for blocking the rotation of said shaft (15) when said shaft (15) is not connected with said rotation means (12, 20, 22), said blocking means comprising:

at least one first pin (25, 26, 27) that is axially slidable with respect to said shaft (15) but constrained in rotation with said shaft (15);

a first seat (28, 29, 30) for housing said first pin (25, 26, 27) integrally connected with said rolling-shutter box (16), said first pin (25, 26, 27) being movable between at least one third position at which said first pin (25, 26, 27) is at least partially housed in said first seat (28, 29, 30), and a fourth position at which said first pin (25, 26, 27) is outside said first seat (28, 29, 30), said first pin (25, 26, 27) being in the third position when said rolling-shutter box (16) and said lateral profile (17) are mutually disconnected.

2. The system (1) according to claim 1, characterized in that it comprises:

means for maintaining said first pin (25, 26, 27) in the third position;

means (33, 34) for guiding said first pin (25, 26, 27) between the third position and the fourth position, said guide means (33, 34) being connected to said shaft (15);

means (35, 36, 37) for ejecting said first pin (25, 26, 27) from said first seat (28, 29, 30), said ejection means (35, 36, 37) being connected to said lateral profile (17).

3. The system (1) according to claim 2, characterized in that said maintenance means comprise at least one first plate (31) integrally connected with said rolling-shutter box (16) and including at least one first through hole (28, 29, 30) acting as said first seat (28, 29, 30), said first pin (25, 26, 27) being at least partially housed in said first hole (28, 29, 30) when said first pin (25, 26, 27) is in the third position, said ejection means (35, 36, 37) comprising at least one second pin (35, 36, 37) integrally connected with said lateral profile (17), said second pin (35, 36, 37) being at least partially housable in said first hole (28, 29, 30), said first hole (28, 29, 30) being penetratable by said first pin (25, 26, 27) and by said second pin (35, 36, 37) respectively on opposite sides with respect to a plane on which said first plate (31) lies, said second pin (35, 36, 37) being housed in said first hole (28, 29, 30) when said rolling-shutter box (16) and said lateral profile (17) are mutually connected.

4. The system (1) according to claim 3, characterized in that said maintenance means comprise the friction between said first pin (25, 26, 27) and the wall of said first hole (28, 29, 30) in which said first pin (25, 26, 27) is fitted when said first pin (25, 26, 27) is in the third position.

5. The system (1) according to claim 2, characterized in that said maintenance means comprise elastic means suitable for maintaining said first pin (25, 26, 27) in the third position.

6. The system (1) according to claim 2, characterized in that said guide means (33, 34) act as means for connecting said first pin (25, 26, 27) to said shaft (15), guide means (33, 34) being suitable for allowing a translation of said first pin (25, 26, 27) parallel to a rotation axis of said shaft (15), guide means (33, 34) being suitable for blocking the rotation of said first pin (25, 26, 27) around said rotation axis.

7. The system (1) according to claim 3, characterized in that said guide means (33, 34) include at least one circular crown acting as first means for blocking said first pin (25, 26, 27) in the fourth position when said rolling-shutter box (16) and said lateral profile (17) are mutually connected, said circular crown having a symmetry axis orthogonal to said first plate (31) and coinciding with said rotation axis of said shaft (15).

8. The system (1) according to claim 2, characterized in that said guide means (33, 34) comprise at least one second plate (33) including at least one second through hole (34), said shaft (15) traversing said second plate (33) at said second hole (34), said second plate (33) being translatable on said shaft (15), said first pin (25, 26, 27) being integrally connected to said second plate (33).

9. The system (1) according to claim 8, characterized in that said second plate (33) is shaped like said circular crown and has, at said second hole (34), a pair of teeth (44), housed in respective grooves (45) that longitudinally run along said shaft (15).

10. The system (1) according to claim 1, characterized in that said rotation means (12, 20, 22) comprise a third pin (20) coaxial with said shaft (15), said shaft (15) comprising a second seat (21) for housing said third pin (20), the housing of said third pin (20) in said second seat (21) connecting said shaft (15) to said rotation means (12, 20, 22), the connection of said rolling-shutter box (16) to said lateral profile (17) causing the housing of said third pin (20) in said second seat (21).

11. The system (1) according to claim 1, characterized in that said command means (18, 19) are movable between at least one fifth position at which, when said shaft (15) and said rotation means (12, 20, 22) are mutually connected, said separation means (2, 7) are in the first position, and a sixth position at which, when said shaft (15) and said rotation means (12, 20, 22) are mutually connected, said separation means (2, 7) are in the second position, said command means (18, 19) in said second position being blocked in such position by means of second blocking means (41, 42, 43).

12. The system (1) according to claim 11, characterized in that said command means (18, 19) comprise a slider (18) translatable between the fifth position and the sixth position, said second blocking means (41, 42, 43) comprising:

at least one first stop tooth (42) integrally connected with a first tongue (41) that is elastically deformable and integrally connected to said slider (18);

a third seat (43) for housing said first tooth (42), said first tooth (42) being housed in the third seat when said slider (18) is in the sixth position.

13. The system (1) according to claim 11, characterized in that it comprises third means for blocking said command means (18) in said fifth position.

14. The system (1) according to claim 13, characterized in that said third blocking means comprise:

a fourth seat for housing said first tooth (42), said first tooth (42) being housed in said fourth seat when said slider (18) is in the fifth position.

15. The system (1) according to claim 13, characterized in that said third blocking means comprise:

at least one second stop tooth integrally connected to a second tongue that is elastically deformable and integrally connected to said slider (18);

a fifth seat for housing said second tooth, said second tooth being housed in the fifth seat when said slider is in the fifth position.

* * * * *